United States Patent [19]

Pan et al.

[11] 4,428,787

[45] Jan. 31, 1984

[54] WRAPPING OF CABLE CORE UNITS

[75] Inventors: Ali Pan, Storrington; John R. Ellwood, Napanee, both of Canada

[73] Assignee: Northern Telecom Limited, Montreal, Canada

[21] Appl. No.: 369,341

[22] Filed: Apr. 19, 1982

[51] Int. Cl.[3] ..... H01B 13/26

[52] U.S. Cl. ..... 156/54; 156/55; 156/56; 156/201; 156/202; 156/463; 174/36; 174/103; 174/113 R

[58] Field of Search ..... 156/54, 55, 56, 201, 156/202, 463, 465; 174/36, 103, 104, 113 R, 117 R

[56] References Cited

U.S. PATENT DOCUMENTS

| | | | |
|---|---|---|---|
| 2,538,019 | 1/1951 | Lee | 156/54 |
| 2,947,652 | 8/1960 | Burr | 174/117 R X |
| 3,404,217 | 10/1968 | Kelly | 156/54 X |
| 4,085,284 | 4/1978 | Olszewski et al. | 174/36 |

*Primary Examiner*—Robert A. Dawson
*Attorney, Agent, or Firm*—R. J. Austin

[57] ABSTRACT

A device and method for wrapping a wrapping material to form S-shaped shields around a cable core of two side-by-side core units in which two tubes are provided for passage of the core units. A space between the tubes accepts the thickness of a central region of the wrapping material which has side portions extending away from the central region. Concave turning surfaces extend partially around the tubes and approach each other as they extend towards an outlet end of the tubes. The core units pass along the tubes and the wrapping materials passes along between the tubes while the turning surfaces progressively turn the side portions inwardly towards and around the tubes whereby the side portions are turned around the core units when these emerge from inside the tubes. In a practical arrangement, the turning surfaces are formed by the inside surface of a frusto core.

15 Claims, 14 Drawing Figures

WRAPPING OF CABLE CORE UNITS

This invention relates to the wrapping of cable core units.

During the manufacture of a telecommunications cable it is sometimes required to wrap the core with a metallic shield. In certain constructions, the core is formed by two or more cable core units, each of which is formed from a plurality of pairs of conductors, the conductors in each pair being twisted together to reduce cross-talk. Core wrap is applied over the finished core at a jacketing operation, followed by aluminum shield and jacket extrusion. With such an arrangement, it is known to provide a metallic shield which not only passes around the cable core itself but also between the units of the core so as to separate them and shield one from another. In one particular construction of cable core, side-by-side core units are separated by a metallic shield which has a central region lying between the core units. At each side of the central region of the metallic shield extend side portions of the shield which are wrapped around the core units, one to each unit. The two side portions extend around their respective core units in the same direction of rotation relative to the core so that the metallic shield is of an S shape in a cross-section through the cable core taken normal to its longitudinal direction. Such a shield should completely enclose the core units and to ensure that complete shielding is provided, each side portion of the shield overlaps the other side portion at the position where it extends from the central region of the shield. Such a construction is shown in U.S. Pat. No. 4,085,284 granted Apr. 18, 1978 in the names of J. A. Olszewski and L. Jachimowicz and entitled "D Shield Telephone Cables".

While the S shield construction has particular advantages, it is nevertheless difficult to form. The present invention is concerned with a device for wrapping a metal strip material around core units of a cable core which will provide an S shield around the core units. The invention is also concerned with a method of wrapping a metal strip material around core units of a core in the manufacture of an S shield.

Accordingly, the present invention provides a device for wrapping a metal strip material lengthwise along two side-by-side core units of a cable core comprising:

two tubes, each having an inlet and an outlet end, the two tubes being relatively disposed with their outlet ends located closely adjacent and facing in the same direction, the tubes being spaced sufficiently to accept between them the thickness of a central region of wrapping strip material; and material turning means for turning longitudinally extending side portions of the wrapping material around the core units, said turning means comprising turning surface portions of concave configuration in a cross-section normal to the length of the two tubes, the turning surface portions extending partially around the tubes, one to each tube, with the turning surface portions facing across the tubes towards each other, and the turning surface portions extending along the tubes and approaching each other to become closely adjacent to the tubes at the outlet ends.

In a preferred arrangement, the turning means completely surrounds the tubes and defines a frusto-conical inwardly facing turning surface which includes the turning surface portions, and the turning surface tapers towards the outlet ends of the tubes. Also in a preferred construction, the tubes lie substantially parallel to each other for at least part of their lengths as they extend upstream from their outlet ends or, alternatively, the tubes converge as they extend to their outlet ends at which position they lie closest together.

The invention also includes a method of wrapping a metal strip material lengthwise along two side-by-side core units of a cable core to locate a central region of the strip material between the core units and side portions of the strip material extending from said central region, one at least partly around each of the core units, said method comprising:

(a) passing the two core units, one down each of two tubes which are relatively disposed with outlet ends closely adjacent and facing in the same direction;

(b) moving the strip material in the same general direction as the core units with said central region located between the tubes and the side portions projecting laterally from between the tubes;

(c) turning the side portions around the tubes, one around each tube, by urging the side portions inwardly towards the tubes while displacing longitudinal edges of the strip material angularly around the tubes; and (d) passing the core units side-by-side downstream from the outlets of the tubes while passing the strip material downstream from around the tube outlets with the central region of the strip material disposed between the core units and the side portions wrapped around the core units.

Embodiments of the invention will now be described by way of example, with reference to the accompanying drawings in which:

FIG. 1 is a cross-sectional view taken normal to its longitudinal axis of a telecommunications cable;

FIG. 2 relates to a first embodiment and is a side elevational view of a device for wrapping a metal shield around core units of the cable of FIG. 1;

Figure 1:
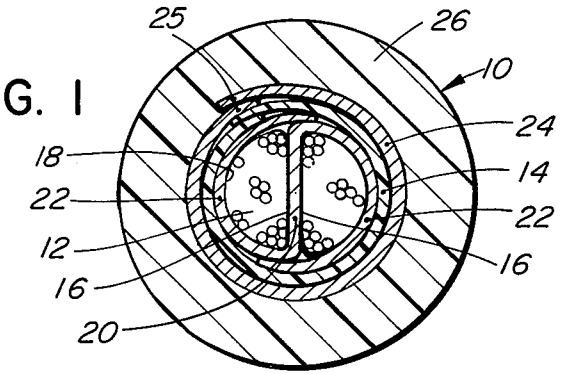

As shown in FIG. 1, a telecommunications cable 10 comprises two core units 12 each formed from twenty-five pairs of conductors, the conductors in each pair being twisted together. The two core units are each of substantially 'D' shape in that they have a partially circular surface and a substantially flat surface 16, the flat surfaces being in opposition as shown by FIG. 1, to form the core units in their assembled condition into a core of substantially circular cross-section.

The core is provided with a metal shield 18. This shield is formed from aluminum strip and has a central portion 20 which lies between the two flat surfaces 16 of the core units. The shield extends outwardly from each side of the central region to form a side portion 22 and each side portion surrounds a respective core unit 12. The side portions continue completely, each around the curved surface of its own core unit 12, and each side portion 22 overlaps a part of the other side portion adjacent to the position at which it merges with the central region 20. The aluminum strip is covered on both sides with a plastics layer (not shown).

Surrounding the metal shield 18 is a core wrap 14 formed from plastic material in the form of tape or strip and an aluminum shield 24 extends around the core wrap. The shield 24 is coated on both sides with plastic and has overlapped ends 25. A jacket 26 of plastics material such as polyethylene is extruded around the outside of the shield. The heat from the extrusion process causes the plastic on the outer surface of the shield 24 to fuse to the plastic of the jacket and also causes the plastic of the overlapped ends 25 to bond together.

Figure 2:
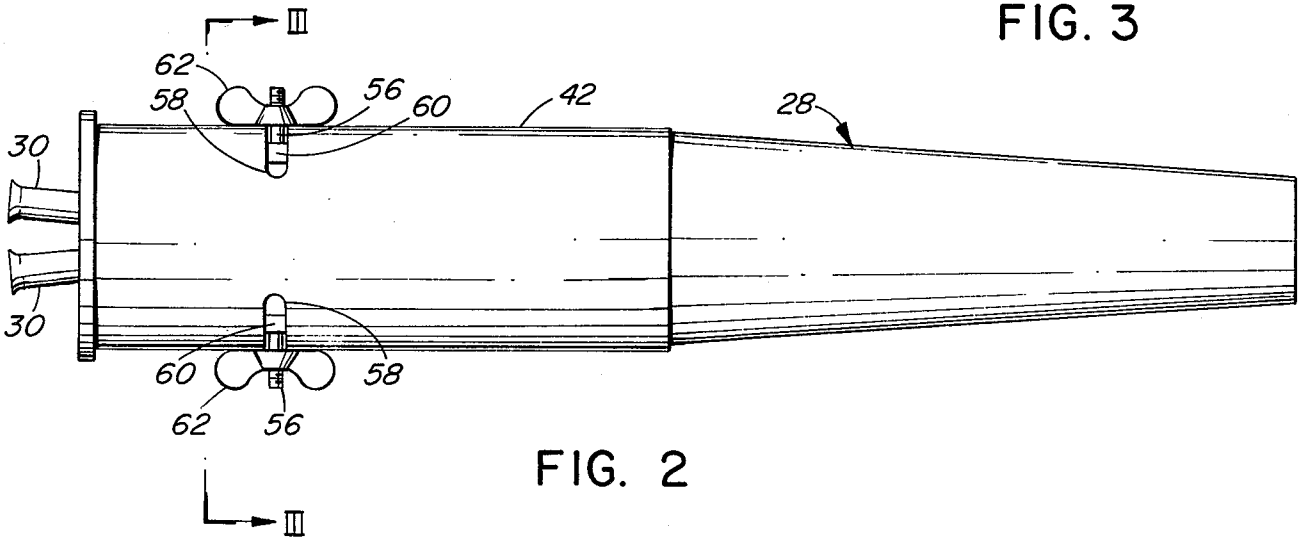

The shield 18 is formed around the core units by a device 28 (FIG. 2) which is constructed as follows.

Figure 5:
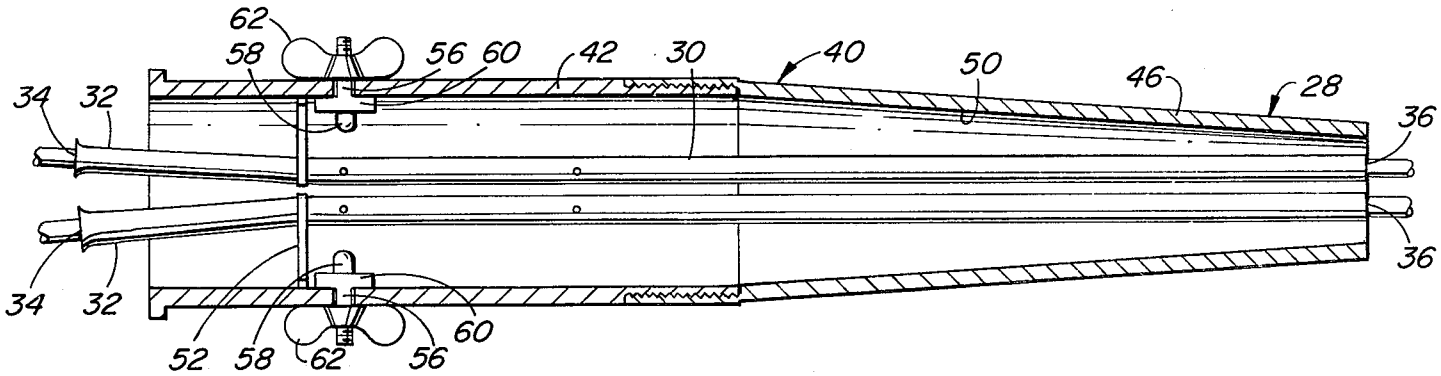
FIG. 5 is a cross-sectional view of the device taken along line V—V in FIG. 3.

The device 28 comprises two tubes 30 which are kinked at their upstream ends 32 so that they converge as shown in FIG. 5 towards a position a short distance downstream from their inlet ends 34. For the remainder of their lengths from the kinked position, the tubes extend substantially parallel to their outlet ends 36. The tubes are flared and care of circular cross-section at their inlet ends. In each tube at its kinked position there is a 'D' shaped die 38 of the shape shown in FIG. 3. The shape of each tube changes progressively from circular to the 'D' shaped of the die downstream from its flared inlet. The die 38 is for shaping a substantially circular core unit into the 'D' shape it assumes in the cable core shown in FIG. 1.

The two tubes are held in fixed relative positions by being mounted within a material turning means 40 which comprises a substantially cylindrical tube 42 surrounding the tubes 30. The tubes 30 are held substantially centrally down the tube 42 by securing means in the form of two brackets 44 which are secured one to each tube 30. The brackets 44 extend diametrically outwards from the tubes 30 to be held by screws to the inner surface of the cylindrical tube 42.

Figure 4:
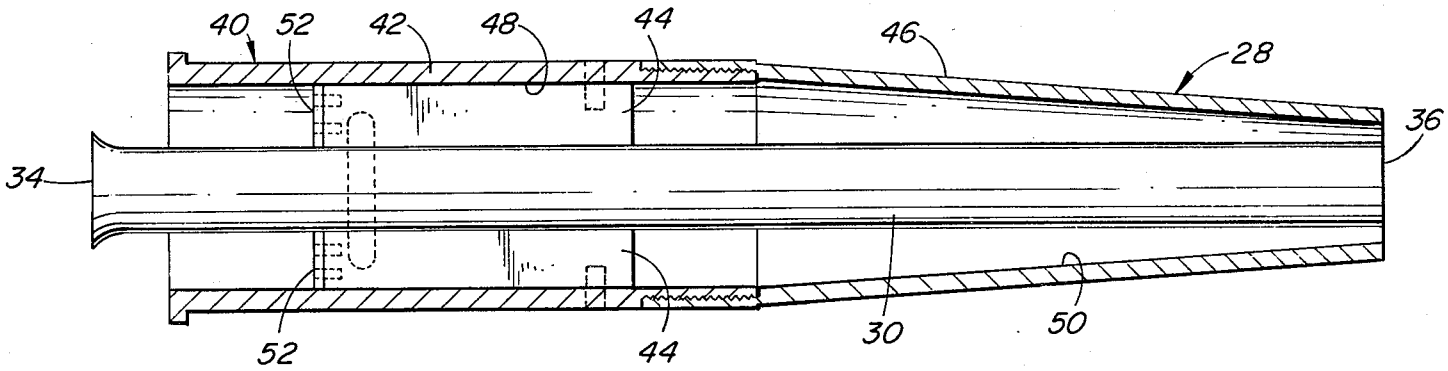
FIG. 4 is a cross-sectional view of the device taken along line IV—IV in FIG. 3.

Downstream of the cylindrical tube 42, the turning means 40 also comprises detachable frusto-conical member 46 which is received in screw threaded engagement with the tube 42. As shown by FIGS. 4 and 5, the frusto-conical member has a larger diameter end which merges with an inner cylindrical guide surface 48 of the tube 42. The member 46 defines a frusto-conical inwardly facing material turning surface 50 which at a downstream end of the member 46, i.e. adjacent to the outlet ends 36 of the tubes 30, lies close to the outer surfaces of the tubes 30.

Figure 9:
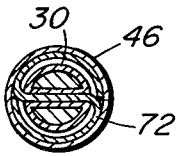
Figure 8:
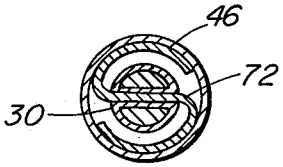

The device 40 is provided for turning strip material around the core unit 12 during formation of the shield 18 by engagement with turning surface portions of the concave configuration of the surface 50. These turning surface portions are parts of the surface 50 which are engaged by the strip as it passes downstream through the member 46 and these portions extend partially around the tubes and face each other across the tubes as is clear from FIGS. 8 and 9 as will be described.

Figure 3:
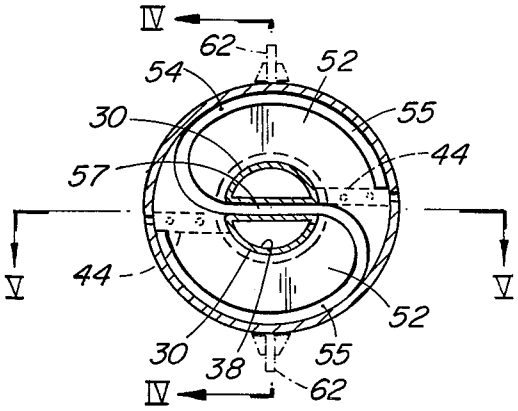
FIG. 3 is a cross-sectional view of the device of FIG. 2 taken along line III—III in FIG. 2.

Towards an upstream end of the tube 42, and in the region of the kink in the tubes 30, are disposed two forming plates 52 for feeding the aluminum strip material into the tube 42 with an initial shape in cross-section which will enable the member 46 to urge the side portions of the strip around the core units to provide the structure shown in FIG. 1. As shown by FIG. 3, the two forming plates 52 are attached to upper ends of the brackets 44 and extend across the opening of the tube 42. Between them and in conjunction with the inner surface 48, the plates 52 provide an opening or slot 54 of 'S' shape. This 'S' shaped slot has two ends 55 extending between the plate 52 and the surface 48, and a central region 57 which is aligned with a gap provided between the two tubes 30. This gap and the width of the slot 54 are sufficient to accommodate the thickness of the material to be used for the shield 18 as the material is fed through the slot.

The device also comprises an edge guide means which extends inwardly of the cylinder 42 towards the tubes 30. This guide means comprises two diametrically opposed guide pegs 56 which extend through circumferentially extending slots 58 (FIG. 2), the pegs 56 being 'T' shaped and having heads 60 which provide guides for the side edges of the wrapping material as it passes along the cylinder 42. These heads extend longitudinally of the cylinder 42 so that the edges of the material will pass along the heads for alignment purposes. A nut 62 received upon each peg 56 is provided for screw-fitted assembly of the pegs onto the cylinders 42 and also to enable its peg to be adjusted in position circumferentially around a slot 58 so as to adjust the desired position of a side edge of the material as it passes along the cylinder 42.

The device 40 forms part of an apparatus for applying the shield to the core of the cable. This apparatus also includes a closing die 64. This closing die operates in a normal fashion for closing dies in that it operates to urge the shield closely into contact with the core after shaping. The closing die is followed downstream by a conventional binding device 66 which carries a spool 68 of binding tape 70 which is wrapped automatically around the shield covered core as it passes from the binding head 66.

Figure 6:
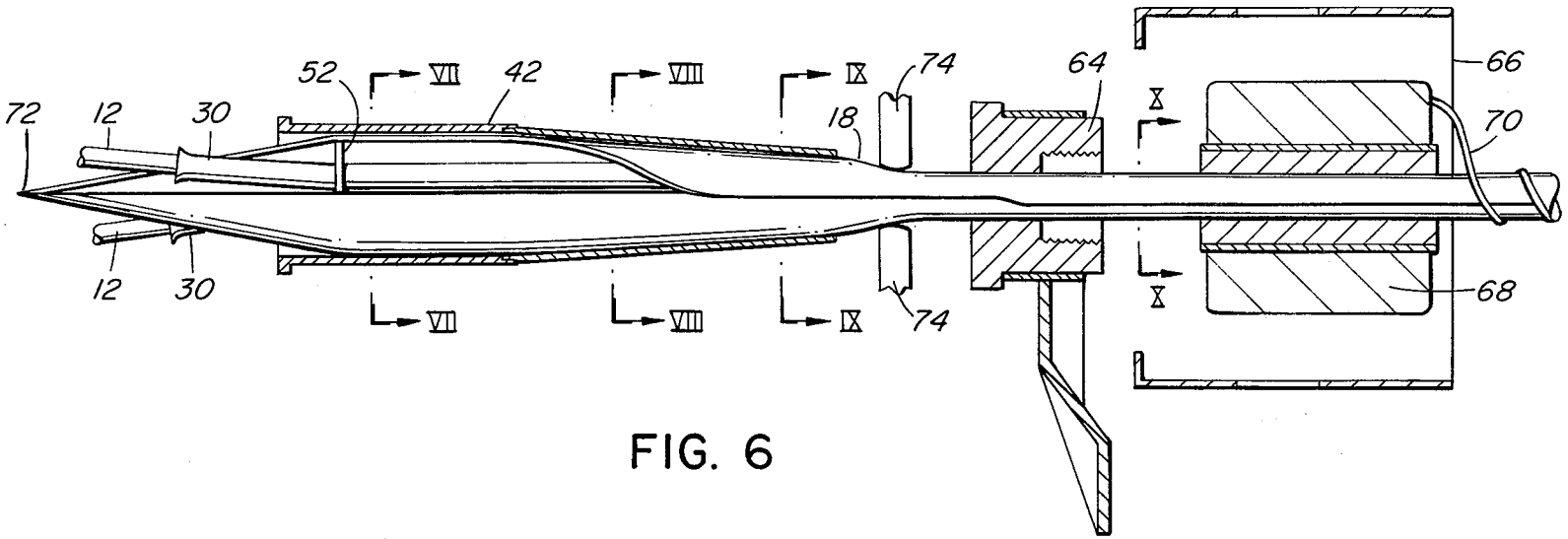
FIG. 6 is a side elevational view, in cross-section, of apparatus for wrapping the metal shield around core units of the cable of FIG. 1, said apparatus including a device as shown in FIGS. 2 to 5.
Figure 10:
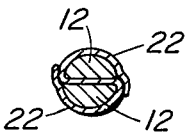
FIGS. 7, 8, 9 and 10 are cross-sectional views respectively through the apparatus of FIG. 6 along lines VII—VII, VIII—VIII, IX—IX, and X—X.
Figure 7:
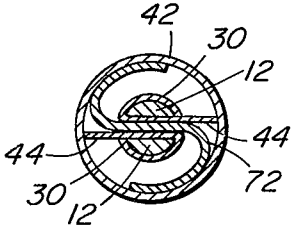

In use, the two core units 12 are passed one down each of the tubes 30, out through the outlet ends of the tubes, through the closing die and thence through the binding device 66 as shown in FIG. 6. As the units pass into the inlet ends 34 of the tubes 30 and then through the dies 38, the core units are formed into their 'D' shape. A length 72 of aluminum strip is passed between the core units 12 as they approach the tubes 30. The aluminum strip then proceeds between the tubes and the side portions of the strip are received within the slot 54 of the guide plates 52 to form the strip into 'SS' shape according to the slot. As the material 72 proceeds along the cylinder 42, the edges of the material are engaged by the heads 60 of the pegs 56 to hold the material in its desired position. The configuration of the material 72, which is as shown by FIG. 7, is maintained until the material enters the frusto-conical surface 50. Upon entering this surface and moving along it, the decrease in diameter of the surface 50 urges the side portions of the material towards the tubes 30 and this movement is simultaneously accompanied by necessary displacement of the side portions of the material angularly around the tubes so that the side portions progress inwardly toward the tubes 30. Hence, upon reaching the position of FIGS. 8 and 9, the side portions of the material 72 are turned around the tubes to the positions shown.

The diameter at the outlet to the frusto-conical member 46 is such that upon the core units issuing from the outlets 36 of tubes 30 together with the issuing of the material 72 from the member 46, the material 72 substantially surrounds both of the core units 12 and lies close to them without being in intimate engagement with the core unit. At this stage, while the material forms the shield 18, the side portions of the shield are not closed completely down onto the core units 12.

Between the downstream end of the member 46 and the closing die 64 there is a gap of several inches. This gap, which may be around 6 inches, is provided to enable visual inspection of the assembly of core units and the shield 18 as it issues from the member 40. As the assembly moves through this gap, there is a tendency for the side portions 22 of the shield to spring slightly away from the core units and this action does not assist in closing the shield. Some method needs to be provided for restricting the degree of opening of the shield. The side portions 22 of the shield are held down upon the core units 12 by two fingers 74 which are diametrically oppositely disposed in the gap on each side of the core. These fingers 74 are adjustable in position by mechanical means (not shown) and are merely held against the side portions 22 to retain them in position down on the core units as the assembly proceeds towards the closing die.

Upon reaching the closing die, the core units and the shield 18 proceed therethrough and the closing die urges the side portion 22 down more closely into contact with the core units. This action effectively overlaps the edges of the side portions 22 each around the other side portion at the position where the side portion merges with the center region 20. The position of the shield is then as shown in the cable assembly of FIG. 1. The assembly of shield and core units then proceeds through the binder 66 and the binding tape 70 is wrapped around the shield 18 before the assembly proceeds to have the core wrap 14 applied and to an extrusion device for extruding the jacket 26 around the assembly.

The invention provides a simple method of providing a shield 'S' shape from a single layer of material to extend around two core units of a core while shielding one from the other. The operation of the device is simple and automatically forms the shield during progression of the shield material and the core units through a continuous cable forming process.

Figure 11:
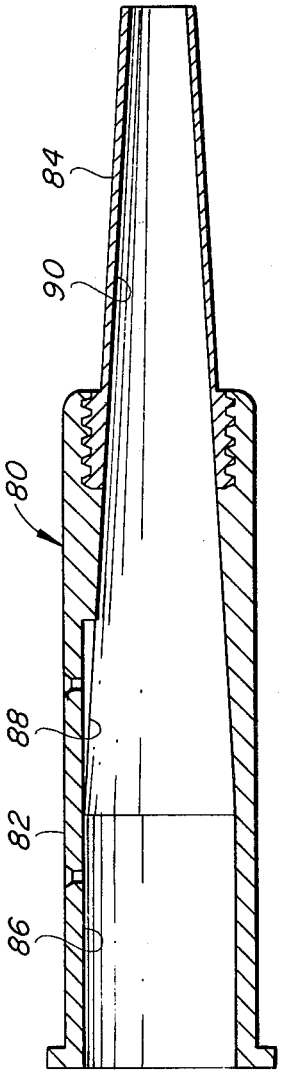
FIG. 11 is a cross-sectional view similar to FIG. 4 through a device according to a second embodiment.

In a second embodiment, as shown by FIG. 11, a device 80 is similar in construction to the device 40 of the first embodiment. The device 80 differs from that of the first embodiment, however, in that while it has a cylindrical member 82 preceding a frusto-conical member 84, the change from the cylindrical forming surface to the frusto-conical surface does not take place at the connecting position between the two members. As shown by FIG. 11, the cylindrical member 82 is formed partially along its length with a cylindrical surface 86 and this then merges into a frusto-conical surface 88. The surface 88 continues downstream as a frusto-conical surface 90 of the member 84 which is screw-fittedly received within the downstream end of the member 80. It should be noted that, as shown by FIG. 11, the frusto-conical surfaces 88 and 90 need not taper at the same rate for efficient turning of the side portions of the shield to take place.

The device 80 is used in apparatus similar to that shown in FIG. 6 and need be described no further.

Figure 13:
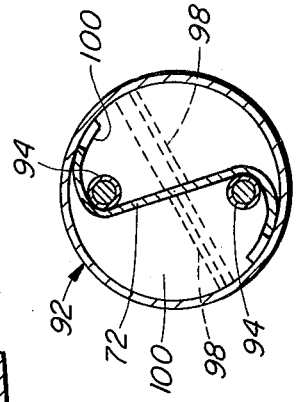
FIG. 13 is a cross-sectional view along line XIII—XIII in FIG. 12.
Figure 12:
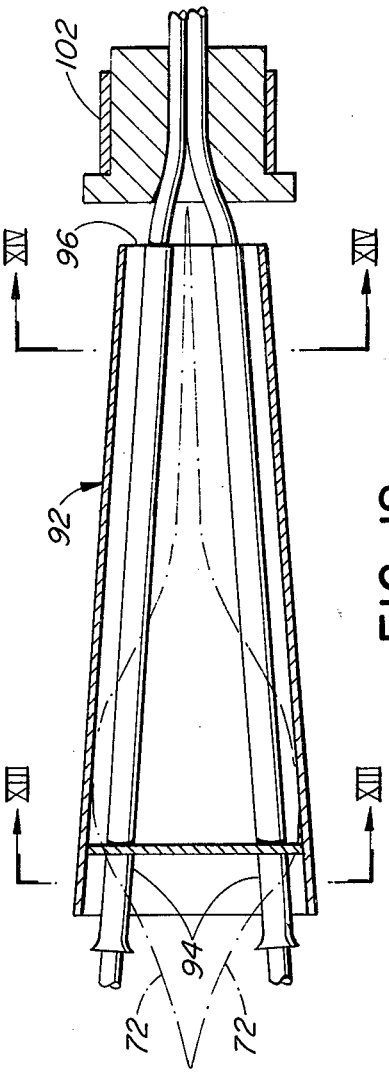
FIG. 12 is a side elevational view, partly in cross-section of an apparatus including a device according to a third embodiment.

In a third embodiment shown by FIG. 12, a device 92 is completely frusto-conical without a cylindrical member and has two core unit guide tubes 94 which extend in convergent fashion from a large diameter upstream end of the member 92, through the member, to its downstream end 96 at which the tubes 94 terminate. Each tube is held at an upstream end portion to the member 92 by brackets 98 as shown by FIG. 13.

Figure 14:
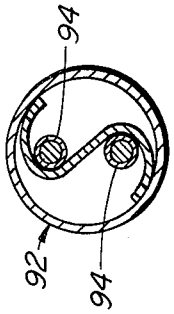
FIG. 14 is a cross-sectional view taken along lines XIV—XIV in FIG. 12.

In use of the device 92, the device is located again upstream of a closing die and binder as described in the first embodiment. Core units are fed through the tubes 94, as shown in FIG. 12, and out through the downstream ends of the tubes with the shield material 18 wrapped around them. The length 72 of material is fed through the tubes as described in the preceding embodiments and then through a forming die plate 100 (FIG. 13) at the upstream end of the member 92. This plate operates similarly to the plate 52 described in the first embodiment and forms the material 72 into 'S' shape as has previously been described. As the material 72 passes along the member 92, the edges of the side portions are urged angularly around the tubes to curve the side portions around the tubes. The amount of material lying between the tubes moves out from between the tubes as they converge together and progresses around the surface of the member 92 so as to form the side portions 22 and the central portion 20 between them (FIG. 14). The assembly of core units and shield then issues from the member 92 with the shield closely surrounding the core units 12 but not in intimate engagement therewith, i.e. in the manner described in the first embodiment.

It is worthy of note that in this embodiment the tubes 94 are not of 'D' shape as described in the first embodiment but are of circular cross-section to accommodate in sliding fashion the core units 12 before these are formed into 'D' shape. Upon the assembly of core units and the shield issuing from the downstream end of the member 92, the assembly passes through the closing die 102 which not only urges the side portions of the shield intimately into contact with the core units, but also has a suitably shaped die to bring the core units together and form them into 'D' shape. The core is then of substantially circular shape as shown in FIG. 1.

The above embodiments have been described for the manufacture of cable as shown in FIG. 1. However, a cable similar to FIG. 1 and devoid of the aluminum shield 18 and core wrap 14 may have its screen 18 applied by apparatus according to any of the above embodiments. In this further cable (not shown), a core wrap is positioned around each core unit 12, the core units then being brought together in the device 28, 80 or 92 and the shield 18 applied as described above. With this cable, the jacket 26 lies around the shield 18 and the plastic covering the shield is bonded to the jacket. Also, the ends of the shield 18 are bonded to the parts of the shield which they overlap by fusing together of the covering plastic layers under the influence of the extrusion heat.

What is claimed is:

1. A device for wrapping a metal strip material lengthwise along two side-by-side core units of a cable core comprising:

two tubes each having an inlet end and an outlet end, the two tubes being relatively disposed with their outlet ends located closely adjacent and facing in the same direction, the tubes being spaced sufficiently to accept between them the thickness of a central region of wrapping strip material;

material turning means for turning longitudinally extending side portions of the wrapping material around and out of intimate contact with the core units, said turning means comprising turning surface portions of concave configuration in a cross-section normal to the length of the two tubes, the turning surface portions extending partially around the tubes, one to each tube, with the turning surface portions facing across the tubes towards each other, and the turning surface portions extending along the tubes and approaching each other to become close to but spaced from the tubes at the outlet ends; and a closing die downstream of the tubes and of the material turning means and having a die surface defining a passage of smaller cross-section than the turning surface portions to draw the side portions of the material into close intimate contact with the core.

2. A device according to claim 1, wherein the turning means surrounds the tubes and defines a frusto-conical inwardly facing turning surface which includes the turning surface portions, the turning surface tapering towards the outlet ends of the tubes.

3. A device according to claim 2, wherein the tubes lie substantially parallel for at least part of their lengths upstream from their outlet ends and each turning surface portion approaches its associated tube as it approaches the outlet end of the tube.

4. A device according to claim 2, wherein the tubes converge for at least part of their lengths towards their outlet ends at which position they are closest together and each turning surface portion approaches its associated tube as it approaches the outlet end of the tube.

5. A device according to claim 2, wherein the turning means also comprises a substantially cylindrical inwardly facing guide surface with the frusto-conical turning surface extending away from the cylindrical guide surface while tapering towards its end of smaller diameter.

6. A device according to claim 5, including securing means which attach the tubes to the turning means along the part of the turning means which defines the cylindrical guide surface.

7. A device according to claim 2, having material edge guide means extending inwardly of the turning means towards the tubes to engage the longitudinal edges of the wrapping material and hold the material in a desired position relative to the tubes during a wrapping operation.

8. A device according to claim 5, wherein the turning means comprises a first turning member which is formed with a cylindrical guide surface and a second turning member formed with the frusto-conical turning surface, the two members being attached together.

9. A device according to claim 8, wherein the two tubes are secured to the first turning member and extend from the first turning member into the second turning member, the second turning member being detachably assembled to the first turning member.

10. A device according to claim 8, having edge guide means extending inwardly of the first turning member to engage the longitudinal edges of the wrapping material and hold the material in a desired position relative to the tubes during a wrapping operation.

11. A device according to claim 3, wherein the tubes have 'D' shaped dies for forming the core units into 'D' shape in cross-section.

12. A device according to claim 1, wherein at an inlet end of the turning means, at least one forming plate is provided which defines an 'S' shape slot for shaping material into an 'S' shape with turned side portions contacting the turning surface portions of the turning means, the slot having a central region which extends between the tubes.

13. A method of wrapping a metal strip material lengthwise along two side-by-side core units of a cable core, the units devoid of jackets and comprising a plurality of pairs of twisted conductors stranded together, in which a central region of the strip material is located between the core units and side portions of the strip material are provided to extend laterally of the central region, one at least partly around each of the core units, said method comprising:

(a) passing the two core units, one down each of two tubes which are relatively disposed with outlet ends closely adjacent and facing in the same direction;

(b) moving the strip material in the same general direction as the core units with said central region located between the tubes and the side portions projecting laterally from between the tubes;

(c) turning the side portions around the tubes, one around each tube, by urging the side portions inwardly towards the tubes while displacing longitudinal edges of the strip material angularly around the tubes;

(d) passing the core units side-by-side downstream from the outlets of the tubes while passing the strip material downstream from around the tube outlets with the central region of the strip material disposed between the core units and the side portions wrapped around but not in intimate contact with the core units; and (e) suddenly closing the side portions against and into intimate contact with the core units.

14. A method according to claim 13, comprising:

shaping the core units into a substantially 'D' configuration in cross-section by passage through a die opening in each tube, the core units of 'D' shape having confronting flat surface regions between which the central region of the tape is disposed.

15. A method according to claim 13, comprising passing the core units through the tubes and after wrapping of the material around the core units, feeding the assembly of core units and wrapping material through a die which urges the material intimately into contact with the core unit and shapes the core units into a substantially 'D' configuration in cross-section.

* * * * *